United States Patent [19]

Burnside

[11] Patent Number: 4,979,932

[45] Date of Patent: Dec. 25, 1990

[54] APPARATUS AND METHOD FOR SEALING BOX BLANKS

[75] Inventor: Paul Burnside, West Townsend, Mass.

[73] Assignee: International Paper Box Machine Co., Inc., Nashua, N.H.

[21] Appl. No.: 317,747

[22] Filed: Mar. 2, 1989

[51] Int. Cl.[5] ..... B31B 1/64

[52] U.S. Cl. ..... 493/134; 493/72; 493/135; 493/144; 493/179; 493/182; 493/423; 493/441

[58] Field of Search ..... 493/56, 57, 59, 60, 493/69–72, 129, 130, 134, 135, 144, 179, 182, 417, 423, 441

[56] References Cited

U.S. PATENT DOCUMENTS

| | | | |
|---|---|---|---|
| 3,416,411 | 12/1968 | Hittenbrger | 493/134 |
| 3,572,221 | 3/1971 | Baum | 493/417 |
| 3,850,085 | 11/1974 | Klemm | 493/144 |
| 4,469,542 | 9/1984 | Reil | 493/179 |
| 4,547,183 | 10/1985 | Mowry | 493/423 |
| 4,708,708 | 11/1987 | Fries, Jr. | 493/60 |

*Primary Examiner*—Frederick R. Schmidt
*Assistant Examiner*—Jack Lavinder
*Attorney, Agent, or Firm*—Pearson & Pearson

[57] ABSTRACT

A method and apparatus for the manufacture of folded paper boxes with a hemmed seal. One of two edges to be overlapped is skived and folded into a hem. After the edges are locally heated, blanks move individually and successfully along a conveyor for folding and sealing. Just before sealing, the hemmed edge passes between a hem holder and the conveyor to maintain the hemmed edge. The hem holder is heated to prevent the edges from cooling. In one embodiment hot air directed onto the hem from the hem holder forms an air cushion between the hem and the hem holder thereby to minimize any contact between the hem holder and the blank.

14 Claims, 4 Drawing Sheets

APPARATUS AND METHOD FOR SEALING BOX BLANKS

FIELD OF THE INVENTION

This invention generally relates to the field of paper box folding, gluing and sealing and more specifically to an improved apparatus and method for providing a box with a sealed, hemmed edge.

BACKGROUND OF THE INVENTION

This invention has particular application to paper box folding and gluing apparatus that move blanks along a paper line to form open-ended boxes with a longitudinal seam as an intermediate packaging stage. Typically the seam is formed by simply overlapping the longitudinal edges of a blank coated with a thermoplastic material. The edges are locally heated, overlapped, and sealed by pressing them together while they cool to form the seal. Alternatively the thermoplastic may be replaced by some form of adhesive that is applied to the edges prior the sealing operation.

Such apparatus have utilized hot air directed by nozzles onto selected portions of each blank to activate a thermoplastic resin or other material prior to mechanically forcing the edges together form a seal. Such apparatus are described in the following U.S. Letters Patents:

| U.S. Pat. No. | Applicant | Issued |
|---|---|---|
| 3,511,139 | Edkvist | May 12, 1970 |
| 3,562,920 | Vuilleumier et al. | February 16, 1971 |
| 3,587,411 | Theys et al. | June 28, 1971 |
| 3,847,540 | Farfaglia et al. | November 12, 1974 |
| 4,252,052 | Meyers et al. | February 4, 1981 |

Other apparatus convert flat blanks into tubular or rectangular units by heating a thermoplastic resin with a nozzle apparatus that does not contact the materials. The heating occurs just prior to a sealing operation. Such apparatus are described in the following U.S. Letters Patents:

| U.S. Pat. No. | Applicant | Issued |
|---|---|---|
| 3,597,900 | Scott | August 10, 1971 |
| 3,751,876 | Oakley | August 14, 1973 |

In many applications, particularly those involving the storage of consumable liquids, such single seals formed by a pair of overlapped edges, such as shown in the foregoing U.S. Letters Patent, are not sufficiently reliable and are prone to leakage.

SUMMARY OF THE INVENTION

Therefore, it is an object of this invention to provide a method and apparatus for forming such cartons with an improved seal.

Another object of this invention is to provide a method and apparatus for producing a carton with a hemmed, multiple layer seal along a longitudinal line.

Still another object of this invention is to provide such a hemmed seal that improves manufacturing reliability by curtailing the accumulation of the thermoplastic material on the manufacturing apparatus.

Yet another object of this invention is to provide a hemmed seal that provides manufacturing reliability by minimizing the deposit of loose thermoplastic material inside the box.

In accordance with this invention, a coated blank has a longitudinal, hemmed seal. Skiving and hemming apparatus form a hem on one edge of the blank that is to be sealed. The blank is heated along the edges thereby to activate a thermoplastic material and then folded. As the blank approaches a sealing zone of the apparatus, a hem holder properly positions the hem for sealing operation. The other edge of the blank folds over the hem immediately preceding the sealing zone wherein the edges are pressed together and cooled to form the final longitudinal seal.

This invention is pointed out with particularity in the appended claims. It may be better understood, however, by referring to the following detailed description taken in conjunction with the accompanying drawings:

DETAILED DESCRIPTION OF THE PREFERRED EMBODIMENT

A paper box folding and gluing apparatus that incorporates this invention can fold box blanks in a wide variety of configurations. For this description, however, it is assumed that the apparatus is adapted to produce boxes coated with a thermoplastic resin that are sealed without any build-up or loose deposits of the resin within the finished box. It will be obvious, however, that other boxes can be formed utilizing this invention even though the requirements for the application are not so strict.

Figure 1:
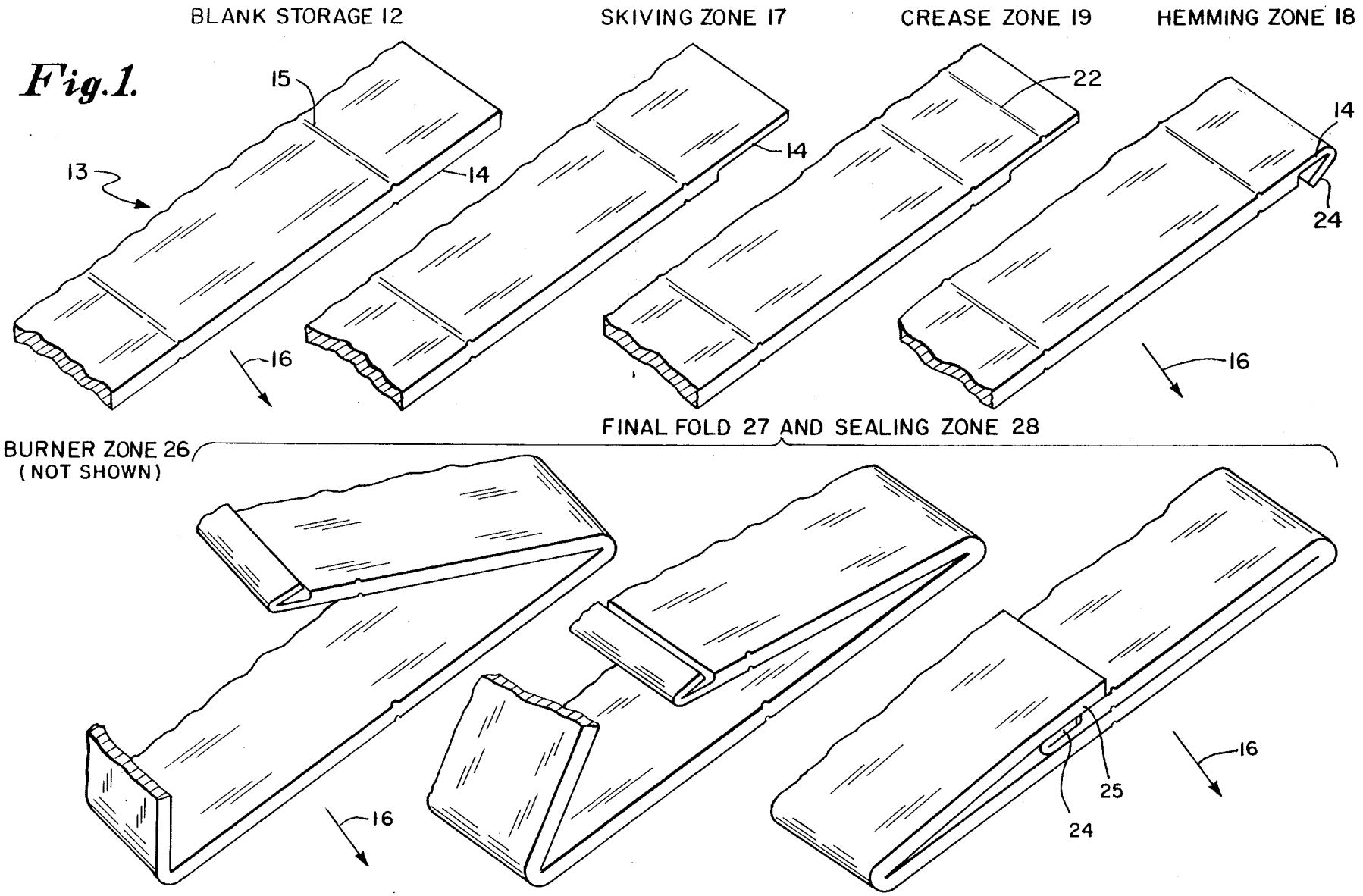
FIG. 1 depicts, schematically, a typical operating sequence for/an apparatus constructed in accordance with this invention and the effects of such operations on a blank.

FIG. 1 depicts, in a block or schematic form, a portion of a box folding and gluing apparatus with a number of zones that perform certain functions in converting a blank to box. The accompanying drawings of portions of a blank to indicate the effect of certain zones on the blank. FIG. 1 depicts a particular sequence, but other sequences are also possible.

Still referring to FIG. 1, a blank storage and feed section 12 provides individual blanks 13 in individually and successivly spaced relationship. Each blank normally is coated with a thermoplastic material that serves two purposes. First, it coats and seals the paper that forms the blank. Secondly, it provides surfaces that can be sealed together merely by selectively heating the material in areas to be sealed and then cooling these areas under pressure. A number of such sealing materials are known.

Each blank 13, as shown in FIG. 1 of the blank storage and feed section 12, contains an edge section 14. The edge section 14 forms the seal with a portion of another edge section not shown in the drawing. Each blank 13 passes, individually and successivly, from the blank storage and feed section 12 along a paper line 16 where prefolding and other operations may occur.

In accordance with this invention, however, the blanks eventually reach skiving zone 17 and crease zone 19 and hemming section 18. As shown in the skiving zone, the apparatus in the skiving zone 17 pares a portion of the edge 14 to a reduced thickness. Normally this skived portion is spaced after the fold line 15 on the blank 13. A hemming zone 18 produces a hem 24 by folding the skived portion of the edge section 14 as shown in FIG. 1.

After the hem 24 is formed it can be sealed to an overlapping portion of an opposite edge section 25 shown in the last zone of FIG. 1. Specifically, the blank moves to a burner section 26, not shown, where the hem 24 and the edge 25 are heated to the working temperature of the thermoplastic resin thereby to activate selectively the sealing material at the portions of the edge sections 14 and 25 that will eventually overlap. Then the blank moves to a final fold zone 27 where the edge sections 14 and 25 are overlapped and sealed in a sealing zone 28 where the two overlapped portions of the edge sections 14 and 25 are squeezed together and cooled thereby to form the seal.

In some applications it may be necessary to apply another thermoplastic material or other adhesive onto the skived portion of the edge section 14 in order that the facing skived surfaces of the double hem are sealed together. In the application shown in FIG. 1, however, such a separate gluing step normally is not necessary as the thermoplastic material on the edge 25 will bond directly to this skived portion.

Figure 2:
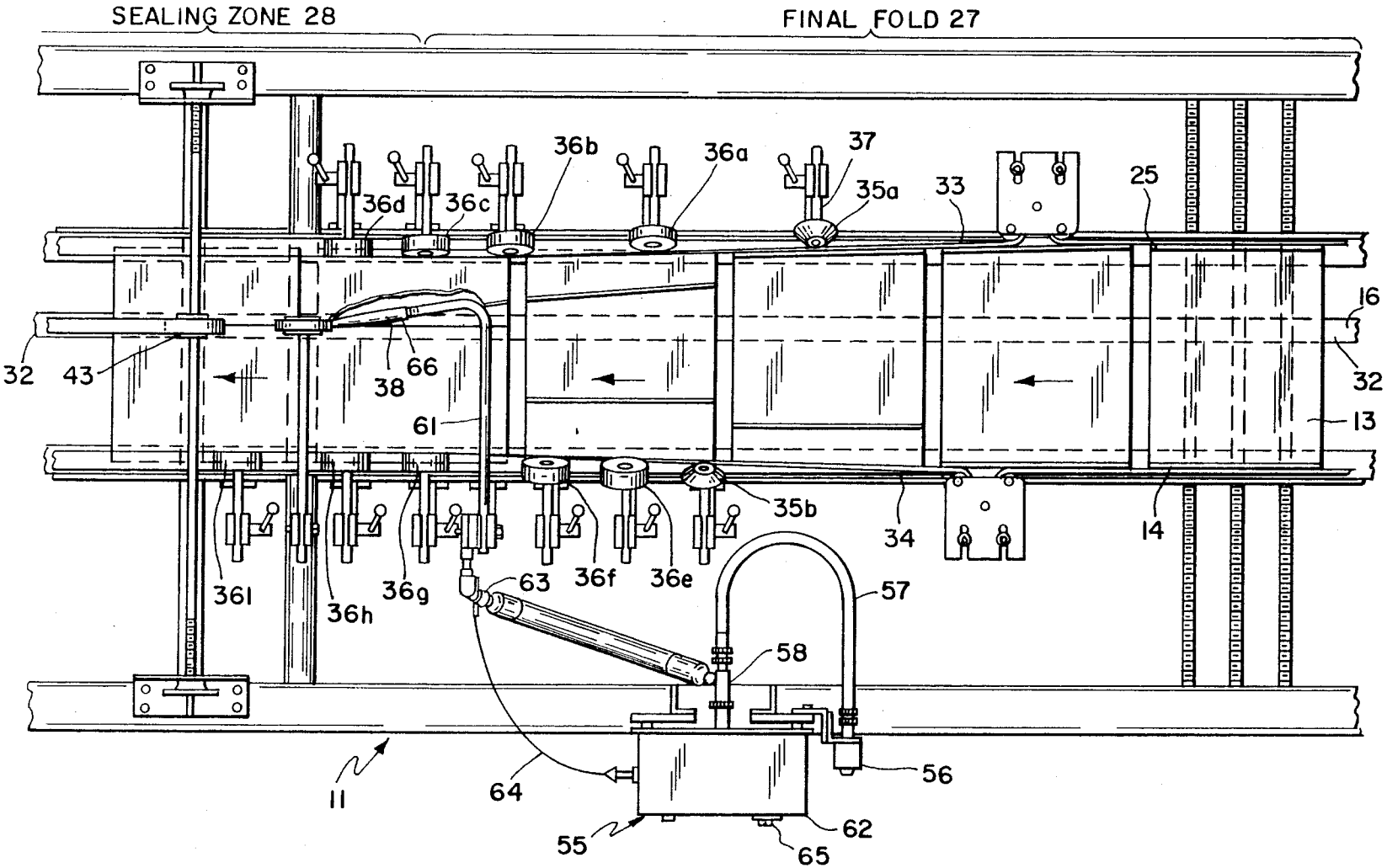
FIG. 2 is a top view of/an apparatus constructed in accordance with this invention.
Figure 3:
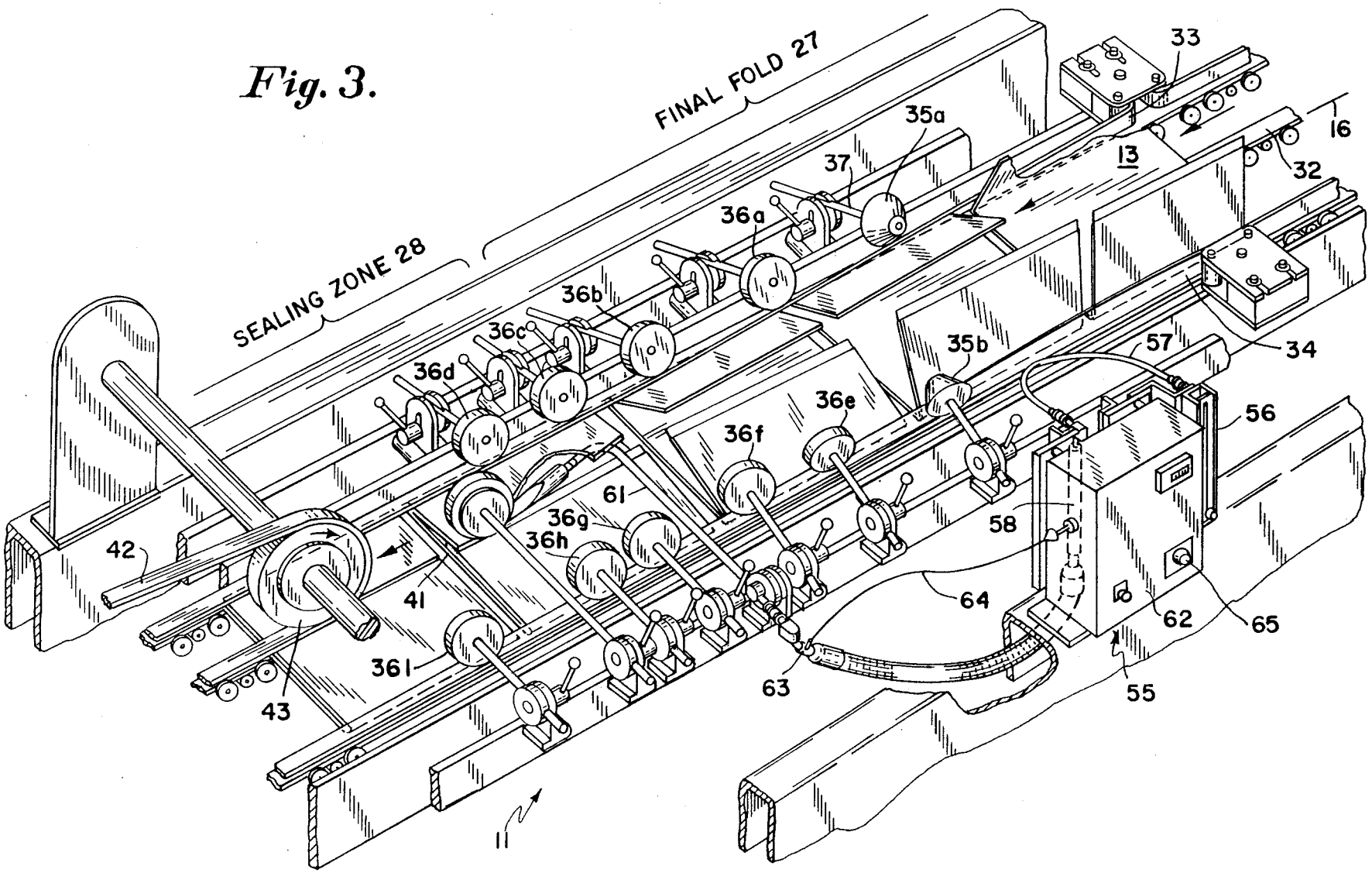
FIG. 3 is a perspective view from a position above the apparatus shown in FIG. 2.

FIGS. 2 and 3 depict a portion of a paper box folding and gluing machine that corresponds to the folding zone 27 and the sealing zone 28 as shown in FIG. 2. These zones act on blanks as they move along the paper line 16, in this case defined by a conveyor 32.

In the folding zone 27, side conveyors 33 and 34 are rotated from a vertical to a horizontal alignment at the sealing zone 28 by a series of idler pulleys to fold the box. With respect to the side conveyor 33, a conical idler pulley **35*a* with a series of cylindrical idler pulleys 36*a*, 36*b*, 36*c*, 36*d* gradually roll the conveyor 33 into a horizontal position. Similarly a conical idler pulley 35*b* and cylindrical idler pulleys 36*e*, 36*f*, 36*g*, 36*h*, and 36*i* move the side conveyor 34** from a vertical to a horizontal position.

As apparent from FIG. 3, apparatus upstream from the portion of the apparatus shown in FIGS. 2 and 3 has prefolded the blanks such that the sides 14 and 25 are vertical while the remainder, or central portion of the blank is in a horizontal plane defined by the conveyor 32. As the blanks move along the conveyor 32, the conveyor 34 folds the edge 14 onto the central portion of the blank while conveyor 33 progressively folds the side 25 over and onto the blank at the sealing zone 28 so the side 25 overlies the edge 14.

It has been found that the hem portion 24 tends to open as the blank 13 travels from the burner section 26 to the sealing section 28. A hem holder 38 that is disposed in the folding zone 27 prevents any such opening from altering the final sealing configuration and affecting the integrity of the seal. More specifically, the positioning of the various idler pulleys by adjustment of their respective supporting axles 37 along the paper line 16 controls the exact timing or sequence of the folding operations with respect to the hem holder 38. With the timing of this particular apparatus the side conveyor 33 folds the flap 25 over the top of the hem holder 38 while the conveyor 34 folds the flap 14 down onto the blank 13 before it reaches the hem holder 38. This hem 24 then slides between the hem holder 38 and the conveyor 32.

As described previously, selected portions of the edge sections 14 and 25 are preheated in the burner section 26. When the blanks pass through the sealing zone 28, first a sealing wheel 41 and then a conveyor 42, running on an idler pulley 43, press the overlapped heated edges 14 and 25 against the conveyor 32 where the thermoplastic material first fuses to the adjacent surfaces and then sets up as the blank 13 cools. This completes the sealing operation, and the blank 13 can then be formed into a carton with a longitudinal watertight hemmed seal in subsequent apparatus.

Figure 4:
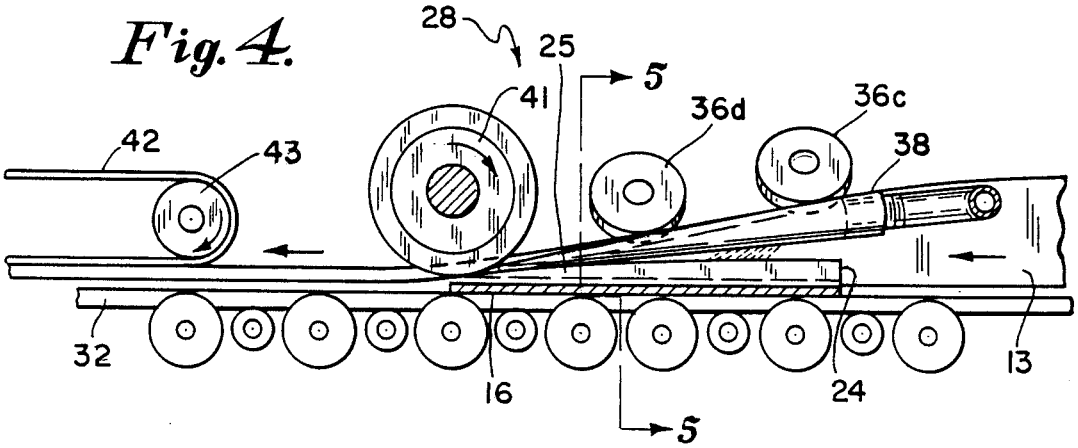
FIG. 4 is a detailed view of a hem holder and sealing portion shown in FIG. 3.
Figure 5:
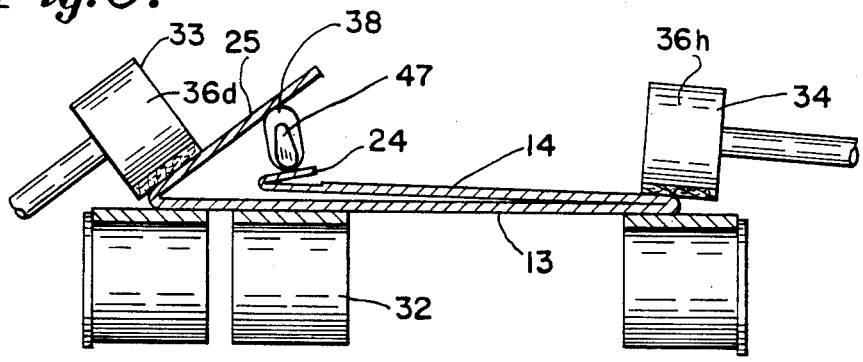
FIG. 5 is a partial sectional view taken along lines 5—5 in FIG. 4.
Figure 6:
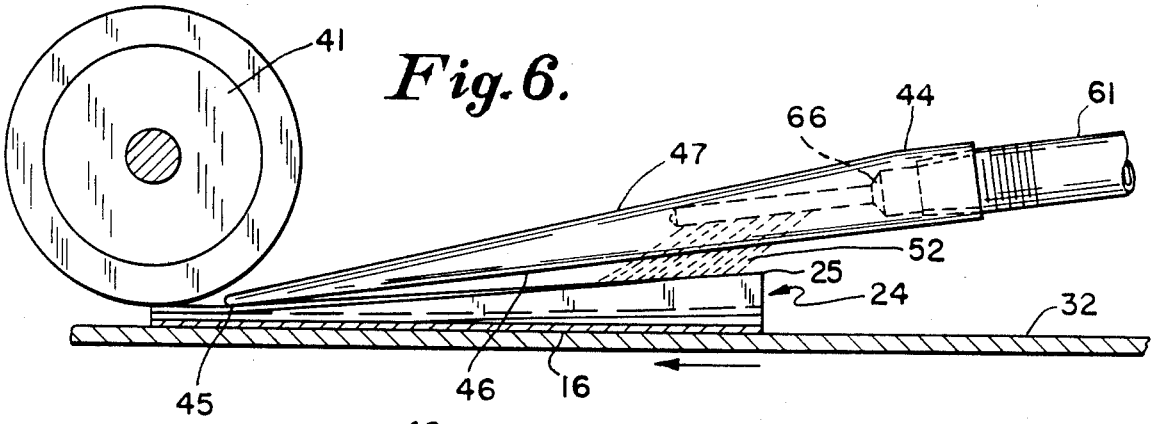
FIG. 6 is an enlarged view of/a hem holder and its relationship with a sealing wheel as they are shown in FIG. 4.

Now referring to FIGS. 4 through 6, the hem holder 38 is formed from generally tubular member 44 and has a central longitudinal axis that lies on a vertical plane through the hem 24. Moreover, this axis intersects the reference plane through the conveyor 32 at an angle having its vertex juxtaposed to the sealing wheel 41. As a result, only a leading edge 45 of the elongated tip 48 of the hem holder at this vertex contacts the hem 24 on the blank 13 adjacent the sealing wheel 41. This improves overall manufacturing reliability because this configuration minimizes any resin buildup that could otherwise deposit onto other portions cf the blank or scrape the heated portions and remove sealing material from the area to be sealed. As shown in FIG. 5, however, the edge section 25 passes over the hem holder 38 and contacts the hem 24 between the leading edge 45 and the wheel 41.

Figure 7:
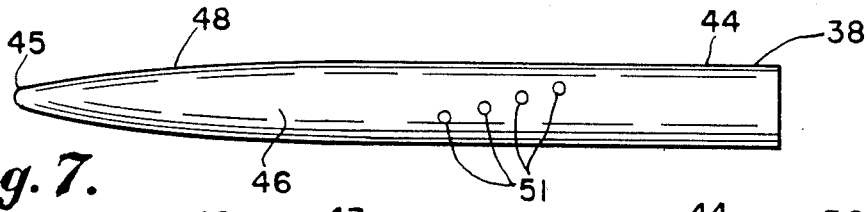
FIG. 7 is a bottom view of a hem holder as shown in FIGS. 4 and 6.
Figure 8:
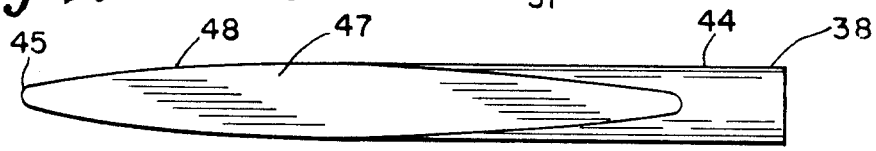
FIG. 8 is a top view of a hem holder as shown in FIGS. 4 and 6.

The hem holder 38 is shown in detail in FIGS. 6 through 8. It comprises a tapered chiseled aluminum tube 44 that terminates at the leading edge 45. A bottom cylindrical surface 46 faces the hem 24 as shown in FIGS. 4, 6, and 7, and a flattened portion 47 on the top faces the edge of the flap 25 as shown in FIG. 4, 5, and 8. During operation the hem holder 38 is heated to a temperature above the working temperature for the thermoplastic materials. This prevents any significant heat loss as the blank moves from the burner section 26 to the sealing zone 28 (in FIG. 1).

In one embodiment, the hem holder is positioned so its longitudinal axis is included at adjustable angles in the vertical plan with respect to the horizontal reference plane, the resulting angle opening upstream (i.e., to the right in FIGS. 2 and 3). Moreover, hot air is forced through the hem holder 38 at a temperature above the 215°-220° F. working termperature of a polyethylene resin.

Referring to FIG. 6 and 7, a plurality of small apertures 51 are drilled through the bottom surface 46 of the tube 38. The apertures 51 direct the air onto the hem portion 24 as it passes below the hem holder 38. As the air is heated, it does not cool the hem 24. Moreover, it is ejected at sufficient pressure and flow (for example, 30 psi with a flow of 62 SCFH) to produce an air cushion 52 intermediate to the hem holder 38. This air cushion 52 keeps the hem 24 folded without contacting the hem holder 38 except at the end area 45. This further reduces the potential for any buildup of thermoplastic resin. It has also been found that improved operation results when the apertures 51 are circumferentially and axially spaced about the bottom surface 46, as shown in FIG. 7.

In a preferred embodiment, a hot air system, shown in FIGS. 2 and 3, comprises a hot air source 55 mounted in close proximity to the sealing zone 28. The heated air supply received cleaned, filtered compressed air from a source not shown. The air is transmitted through a flow regulating valve 56 and a hose 57 into a heat exchanger 58 and then through another hose or conduit 61 to the hem holder 38. Typically a heater controller 62 uses the output from a temperature sensor 63, that is coupled back to the temperature controller unit 62 by a conductor 64, to maintain a constant hot air temperature set by an input control 65.

As also shown in FIG. 6, the conduit 61 terminates in a fitting 66 inside the hem holder 38 that forces the air out of apertures 51 in a forward or downstream direction (i.e., to the left in FIGS. 2 and 3) as shown by the dashed lines 52. This direction is the direction of travel of the blank 13. This further reduces any loss of heat from the blank 13 as it passes under hem holder 38 because the heated air tends to evacuate any cooler atmospheric air that might otherwise accumulate between the hem holder 38 and the blank 13 downstream of the apertures 51.

Thus, in summary, the apparatus shown in the various figures forms a sealed box from a thermoplastic coated blank that has a skived and hemmed edge to form a seal with an overlapped portion of an opposing edge of the blank. As the two edges are being overlapped, the hemmed edge passes between the transporting conveyor and the hem holder that produces a downward force on the hem thereby to maintain it in its folded state.

This invention has been disclosed in terms of certain embodiments. It will be apparent that many modifications can be made to the disclosed apparatus without departing from the invention. Therefore, it is the intent of the apended claims to cover all such variations and modifications as come within the true spirit and scope of this invention.

I claim:

1. In a paper box folding and gluing apparatus for sealing the flaps of a blank to form a box with sealed seams by overlapping portions of first and second edge sections on a blank including means for storing and feeding blanks onto a conveyor means for transport to different operating zones in said machine, the box having a heat-activated sealing material at least at said first and second edge sections, said apparatus comprising:

A. skiving zone means for removing a first portion of the first edge section to produce a skived edge portion, B. hemming zone means for folding an end section of the skived edge section over a second, adjacent section thereby to form a hem at the first edge section, C. means for activating the sealing material at said first and second edge sections, D. means for overlapping portions the first and second edge sections including the hem, E. hem holder means at said overlapping means for directing heated air toward the skived edge portion for forcing the skived edge portion toward the first edge section thereby to maintain the skived edge sections in a hem configuration, and F. sealing means for thereafter pressing the overlapped portions together hereby to form a seal with the skived edge portion intermediate the first and second edge sections.

2. A paper box folding and gluing apparatus as recited in claim 1 wherein the first and second edge sections are on opposite sides of each blank and are folded along parallel fold lines, said overlapping means additionally comprising:

i. first folding means parallel to the conveyor means and to the fold lines for folding the first edge section onto the blank as it moves along said conveyor means, said first edge section passing between said hem holder means and the conveyor means, and ii. second folding means parallel to the conveyor means and to the fold lines for folding the second edge section onto the blank and said hemmed portion as the blank moves along the conveyor means and past said hem holder means, said hem holder means thereby being positioned intermediate the first and second edge sections.

3. A paper folding and gluing apparatus as recited in claim 2 wherein each of said first and second folding means comprises conveyor belt means on a plurality of idler pulleys disposed at different angles along the length of the conveyor means and displaced therefrom, each of said conveyor belt means being reoriented by said respective idler pulley means to fold the respective ones of the first and second edge sections onto the blank.

4. A paper box folding and gluing apparatus as recited in claim 2 wherein the sealing material is a thermoplastic resin and said activating means heats the sealing material above its working temperature, said apparatus including hem holder heating means for heating said hem holder means to prevent a heat transfer away from the first and second edge sections as each blank transfers to said sealing means.

5. A paper box folding and gluing apparatus as recited in claim 4 wherein:

i. said hem holder heating means comprises means for supplying temperature regulated air under pressure to said hem holder means, and ii. said hem holder means comprises a tubular housing having a plurality of apertures for directing the heated air onto the hemmed portion of the first edge section thereby to form an air cushion over the hemmed portion.

6. A paper box folding and gluing apparatus as recited in claim 5 wherein the blanks travel along said conveyor means in a predetermined direction and in a reference plane and said hem holder means additionally comprises support means for positioning said hem holder means along a longitudinal axis in a vertical plane intersecting said conveyor means with the longitudinal axis being angled with respect to the reference plane, said hem holder terminating at a vertex of the longitudinal axis and reference plane juxtaposed to said sealing section.

7. A paper box folding and gluing apparatus as recited in claim 6 wherein said hem holder means comprises a tubular member that extends along the longitudinal axis and is flattened on a first side and a plurality of apertures drilled through said tubular member opposite to said flattened side, said plurality of apertures facing said conveyor means thereby to direct hot air under pressure onto the hem.

8. A paper box folding and gluing apparatus as recited in claim 7 wherein said plurality of apertures lie on an axis that is oblique to the longitudinal axis.

9. A paper box folding and gluing apparatus as recited in claim 2 wherein said hemming zone means includes means for forming said skived edge section into a single hem.

10. A paper box folding and gluing apparatus as recited in claim 2 wherein said hemming zone means includes means for folding said skived portion on itself thereby to form a hem.

11. A method for folding, gluing and sealing the edge of a blank to form a paper box with a hemmed seal, said method comprising the steps of:

A. skiving a portion of first edge section thickness to produce a skived edge portion, B. forming a hem by folding the skived edge portion over an adjacent portion of the first edge section, C. selectively heating portions of first and second edge sections to be overlapped, D. folding concurrently said first and second edge sections to overlap, E. directing hot air toward the hem for forcing the skived edge portion toward the first edge section thereby to maintain the skived edge portion section against the adjacent portion of the first edge section in a hem configuration while said folding overlaps the hem with a heated portion of the second edge section, and F. thereafter sealing the overlapped said first and second edge sections together to form a seal with a skived portion intermediate second edge section and the remaining portion of the first edge.

12. A method for producing a paper box as recited in claim 11 wherein said step of applying force to the skived edge section includes blowing heated air under pressure against the hem.

13. A method for producing a paper box as recited in claim 12 wherein said step of said folding of the skived edge section produces a single layer hem.

14. A method for producing a paper box as recited in claim 12 wherein said hemming step includes the steps of scoring and folding said skived edge section about an intermediate longitudinal folding line thereby folding the skived edge section into a hem.

* * * * *